US005878530A

United States Patent [19]

Eccleston et al.

[11] Patent Number: 5,878,530

[45] Date of Patent: Mar. 9, 1999

[54] REMOTELY CONTROLLABLE AUTOMATIC DOOR OPERATOR PERMITTING ACTIVE AND PASSIVE DOOR OPERATION

[75] Inventors: Jon E. Eccleston; Charles H. Eccleston, III, both of Walnut Creek, Calif.

[73] Assignee: Eccleston Mechanical, San Leandro, Calif.

[21] Appl. No.: 786,488

[22] Filed: Jan. 21, 1997

Related U.S. Application Data

[63] Continuation of Ser. No. 324,234, Oct. 18, 1994, abandoned.

[51] Int. Cl.[6] ..... E05F 15/00

[52] U.S. Cl. ..... 49/139; 49/25; 49/30; 49/340

[58] Field of Search ..... 49/139, 140, 339, 49/340, 334, 333, 345, 25, 29, 30, 279, 280

[56] References Cited

U.S. PATENT DOCUMENTS

| | | | |
|---|---|---|---|
| 3,425,161 | 2/1969 | Catlett et al. . | |
| 3,470,653 | 10/1969 | Kalog . | |
| 3,874,117 | 4/1975 | Boehm . | |
| 4,348,835 | 9/1982 | Jones et al. | 49/139 |
| 4,501,090 | 2/1985 | Yoshida et al. . | |
| 4,604,826 | 8/1986 | Sorber | 49/30 X |
| 4,658,545 | 4/1987 | Ingham et al. . | |
| 4,660,324 | 4/1987 | Nyenbrink . | |
| 4,735,018 | 4/1988 | Duncan et al. | 49/139 X |
| 4,821,024 | 4/1989 | Bayha | 49/30 X |
| 5,018,304 | 5/1991 | Longoria . | |
| 5,040,331 | 8/1991 | Merendino et al. | 49/30 X |
| 5,072,973 | 12/1991 | Gudgel et al. . | |
| 5,095,654 | 3/1992 | Eccleston . | |
| 5,226,256 | 7/1993 | Fries et al. | 49/31 X |
| 5,226,370 | 7/1993 | Templeton . | |
| 5,375,374 | 12/1994 | Rohroff | 49/139 X |
| 5,422,552 | 6/1995 | Parisi | 49/140 X |
| 5,428,278 | 6/1995 | Bollengier et al. | 49/30 X |

OTHER PUBLICATIONS

A copy of a 1992 LCN Closers Catalog, the LCN Door Closer Product Line.

A copy of a Gyro Tech Catalog, Gyro Tech Automatic Door Opener/Closer Product Line.

A copy of a Keane Monroe Corporation Catalog, Door Automation Product Line.

A copy of a Stanley Magic–Door Automatic Door Opener/Closer Advertisement.

Dorma Ed 800 Series, Technical Drawings and Accessories Catalog, pp. 1–12.

*Primary Examiner*—Jerry Redman

*Attorney, Agent, or Firm*—Flehr Hohbach Test Albritton & Herbert LLP

[57] ABSTRACT

A remotely controllable door operator system permitting active and passive use of a door includes a transmitter, a receiver, a master timing sequencing mechanism, a clutch-regulated prime mover that can actively move the door, and a mechanism that senses whether the door is fully closed. The door operator is controllable by depressing a single button on the transmitter, which sends a signal to the receiver. If the sense mechanism determines the door is fully closed, the receiver causes the timing mechanism to cause the prime mover to disengage the door latch and to commence actively opening the door for a first time period. The timing mechanism may be user adjusted to control the extent of the door opening by adjusting the length of the first time period.

9 Claims, 6 Drawing Sheets

REMOTELY CONTROLLABLE AUTOMATIC DOOR OPERATOR PERMITTING ACTIVE AND PASSIVE DOOR OPERATION

This is a continuation of application Ser. No. 08/324,234 filed Oct. 18, 1994 abandoned.

TECHNICAL FIELD

This invention relates to automatic door operators, and more particularly to remotely controllable operators wherein a door may be operated actively and/or passively.

BACKGROUND ART

It is known in the art to equip a hinged or swinging door, or a sliding door with a door operator. As used herein, "operator" shall refer to a non-passive mechanism that produces some movement in a door. Thus, a motor coupled to produce door motion will be deemed an operator, whereas a door-closing coiled spring is not an operator. Further, as used herein, a device that opens a door but does not have integrated door-closing capability will be deemed a door opener.

Operator-equipped doors are frequently found in commercial establishments such as airports, malls or supermarkets where manual operation of the door may be inconvenient to users. Understandably, handicapped individuals, including bedridden and wheel-chair confined individuals, would greatly benefit from operator-equipped doors in their homes and businesses. Unfortunately, however, many factors make it unfeasible for such individuals to benefit from operator-equipped doors.

Many door operators are pneumatically, hydraulically, or electro-mechanically driven, and typically require substantial operating current and/or voltage. Installation of such an operator can include substantial modification to the door, the door frame, and indeed the structure wherein the door and door frame are mounted. Installation of such an operator frequently requires a building permit as well as the services of a skilled professional technician installer. As a result, "do-it-yourself" installation is generally precluded, especially by handicapped persons. The resultant cost of permits, equipment, and labor often prevents handicapped individuals from purchasing door operators for use at home and at work. In addition, conventional door operators often are expensive to maintain.

The installation of door operators is generally costly since different models are normally required depending upon whether the door is left-hinged or right-hinged, and/or whether the door swings inwardly or outwardly. This includes several different door operator linkage configurations which depend upon the operative placement thereof relative to the door. Hence, unless the operator technician first views the premises whereat installation is to occur, both the left-hinged and right-hinged models, as well as a variety of hardware, must be at hand to ensure that installation can be completed.

Moreover, the present door operators are generally large, bulky units which employ high torque, low rpm electric motors which require a minimal amount of gear reduction. This combination is utilized because the device must be capable of being back-driven manually when not powered. Motors of this type are typically large when compared to high rpm motors of equivalent horse power. Due to the large size of the magnets necessary to generate such a high torque at a low rpm, the motor and associated gear reduction mechanisms are relatively large. Often, these bulky door operators are too large to mount directly to the door and must be mounted on or above the door lintel. This may decrease the overall aesthetic appeal, and, without substantial structural modification, may preclude installation and operation of the unit altogether. For example, in a retrofit installation where the upper portion or edge of the door is at or very near the ceiling, the amount of space provided between the door lintel and the ceiling may be insufficient to mount the unit.

Operators utilizing smaller high rpm motors achieve some reduction in size but must increase the ratio of gear reduction to bring about appropriate opening and closing speeds. This has an unfortunate result of substantially increasing the force required to manually move the door when the operator is not powered. This high mechanical resistance precludes the utilization of a spring to bring about the closing of the door which must close under power. Thus, this type of operator must operate in the power mode at all times for all users due to the fact that the internal mechanisms are highly resistant to manual operation. A power outage can render a door thus equipped into a frozen state potentially trapping people in hazardous situations. Typically, operators utilizing door closure spring mechanisms, which are often internally mounted, use low revving high torque motors, and close doors with internal spring mechanisms. Such a spring is compressed during the opening cycle. During the closing cycle, the spring force must be sufficient to close the door, while counteracting the resistance forces caused by the motor and counter-rotating the series of gears (the gear train) coupled to the electric motor. However, this spring force must not be so large as to prevent or substantially impair manual operation of the door, especially for physically impaired individuals. These opposing limitations often result in poor closing performance in windy conditions.

Moreover, in an electrical outage, an individual attempting to further open or close the door may have to exert substantial manual force to overcome the resistance forces generated by the gear train, motor and/or internal or external door check spring. The magnitude of such resistance forces can exceed what a child, a frail or especially a handicapped person can exert. As a result, such individuals may be trapped within a room whose exit includes an operator-equipped door that is so frozen or inoperable to those individuals.

More recently, clutch mechanisms have been introduced between the motor assembly and the driving linkage assemblies. These mechanism are typically employed so as to cause slippage of the mechanisms when encountering obstructions in the powered opening and closing of the door. However, these arrangements most often act in conjunction with external or internal door closing springs for automatically closing the door. A typical example of these mechanisms may be found in U.S. Pat. No. 3,874,117 to Boehm which discloses a door opener (i.e., incapable of closing the door) that is to be used in combination with a standard hydraulic or mechanical door check for door closure. During its activity as a door opener the door is opened, and after passage has occurred, the clutch deactivates allowing a pre-existing spring mechanism to close the door.

This allows better closing characteristics than found in the previously described devices in which the drive-motor counter rotates during closing. Though Boehm's device was an improvement, it was cumbersome in that it required a separate mechanism to close the door. During a power outage, the Boehm system still presents an impediment to manual operation by individuals of limited physical capability because they must overcome the resistance caused by the mechanical doorcheck.

Prior art door operators further tend to preclude passive operation of the door. By passive operation it is meant that when not in the process of being moved by the door operator, the door should be manually movable by a user as though the door were not equipped with an operator or a spring-type closing mechanism. U.S. Pat. No. 5,018,304 to Langoria discloses an operator whose primary purpose is the moving of massive heavy radiation doors which are not readily movable by manual means. Langoria provides an emergency back-up power supply system so that egress may be maintained in the event of a power outage as manual use is extremely difficult. Langoria discloses the use of a clutch which has the purpose of selectively isolating the motor from the massive load. The slippage of the clutch accommodates this need. The clutch in Langoria's invention is engaged at all times either by line voltage or the back-up power supply system. It is never disengaged. The use of the clutch in Langoria is similar to that found in situations where the acceleration of large masses must be smoothly controlled. Examples of this can be found on industrial conveyor belts and on merry-go-rounds. In normal use Langoria's operator precludes manual operation of the door.

Many public buildings are required to have fire doors that are fully open normally but must close automatically in response to a fire alarm signal. This is most commonly achieved by the use of spring type door checks in conjunction with electromagnetic hold open devices which release with the loss of energizing current. After the fire alarm signal has ceased, these doors must again be fully opened. Reopening such doors is typically accomplished manually, a time consuming process if a great many doors are involved. Further, reopening such doors can require exerting a force sufficient to counter a spring bias used to close the doors. The magnitude of this force may in fact preclude non-muscular individuals and many handicapped individuals from being able to reopen the doors to escape a fire. In addition, fire doors that are operator-equipped can consume substantial electrical power in a hold open mode, and typically require an emergency standby power supply to maintain opening capability in the event of power interruption during a fire. In the absence of emergency standby power, even fire doors equipped with an operator can become a dangerous barrier to persons trapped within a room.

It is also known in the art to provide a door with an operator that may be remotely controlled by a user. Pressure sensing or light interrupt photodiode sensing mechanisms are commonly found in supermarket or airport doors, for example. U.S. Pat. No. 5,095,654 to applicant Eccleston discloses a radio controlled pneumatic door operator wherein depressing a single button on the remote control radio mechanism sequentially operates a deadbolt mechanism and door latch on the door and then causes the door to open. The door remains open until such time as the remote control button is again depressed, whereupon the process reverses. The disclosed mechanism could be attached without substantially modifying the door.

While the Eccleston mechanism was a boon to handicapped persons, it was basically a "go/no-go" control mechanism that, like other prior art door operators, did not readily permit a user to partially open or partially close a door.

In summary, what is needed is an inexpensive, low voltage powered door operator that can be installed by an untrained person without substantial modification to the door, door frame, or premises whereat it is used. To help minimize costs and make such operators readily available for purchase by handicapped persons, such an operator should function with various combinations of door configurations including a left-hinged or right-hinged door, and installation should not require expensive permitting procedures.

Further, to facilitate its use by handicapped and non-handicapped individuals, such a door operator should be remotely controllable, and should permit both active and passive use of the door, even in the event of a power interruption or another emergency.

Finally, such a door operator should also be operable in the same manner as a fire door closing device, and respond similarly in the interruption of operating electrical power. However, such a door operator should provide active operation capability to allow persons, including disabled persons, to exit a conflagration otherwise barred by a door.

DISCLOSURE OF INVENTION

Accordingly, it is an object of the present invention to provide an automatic door operator apparatus and method which is capable of selective motor powered opening and closing of a door.

Another object of the present invention to provide an automatic door operator apparatus and method which is normally passive, i.e., which permits substantial unencumbered manual operation of the associated door, except during powered opening, braking & holding the door in a selected position, and closing of the door.

Yet a further object of the present invention is to provide an automatic door operator apparatus and method which operates from a low voltage power source.

Still another object of the present invention is to provide an automatic door operator apparatus and method which is easily retrofit to most existing doors.

Yet another object of the present invention is to provide an automatic door operator apparatus and method which can be substantially mounted to either the door or lintel of the building structure.

A further object of the present invention is to provide an automatic door operator apparatus and method which can be reversibly mounted to either side of the door.

Still a further object of the present invention is to provide an automatic door operator apparatus and method which can be easily installed by unskilled personnel.

It is a further object of the present invention to provide an automatic door operator apparatus and method which is durable, compact, easy to maintain, has a minimum number of components, and is easy to use by unskilled personnel.

The present invention includes a normally passive electric door operator apparatus operably mounted between a structure and a door, where the door is movably mounted to the structure through a door coupling device for movement of the door between a closed position and an open position. Briefly, the door operator apparatus includes an electric motor assembly having an output shaft, and a linkage device operably coupled to the door for movement thereof between the open and closed position. An electronically operated clutch assembly is provided as selectively movable between an active mode and a normally passive mode. In the active mode, the clutch assembly actively couples the output shaft to the linkage device for selective powered movement of the door between the open and closed position. In the passive mode, the clutch assembly decouples the output shaft from the linkage device to permit selective manual movement of the door which is substantially free of movement resistance other than the resistance caused by the door coupling device. The present invention further includes a control mechanism operably coupled to the motor assembly and the clutch assembly for selective operation of the door operator by a user such that the clutch assembly is in the active mode only during powered opening, braking in place at a selected position, and powered closing of the door. For the remainder of the time, the clutch assembly is normally in the passive mode to provide substantially resistance free movement of the door.

A method of the present invention for powered opening and powered closing of a door through a normally passive powered door operator, briefly, comprises the steps of: selectively engaging an electronic clutch assembly to an active mode coupling an output shaft of an electronic motor assembly to a linkage device operably coupled to the door for powered door movement between an open position and a closed position; energizing the motor assembly for driving the powered door movement; and after the energizing step, automatically disengaging the electronic clutch assembly from the active mode to a passive mode. In the passive mode, the clutch assembly permits substantial unencumbered, selective manual movement of the door between the open and closed position. During initiated power operation of the door, the clutch is in its active mode. The active mode includes opening the door to a selectable position, braking and holding the door in this position, and closing the door. The remainder of the time the clutch assembly is in its passive mode freeing the door for manual operation.

Operationally, in a first full or normal cycle mode, the door initially is latched closed but remains passively usable without recourse to the operator. Upon activation, e.g., by detection of a remote control user-generated signal, an initial delay time T1 is generated by a timing sequencer or timer, which T1 permits an unlatching device to actively unlatch a door latch or locking mechanism. After time T1, the sequencer provides a time T2 wherein the motor of door operator i s energized and the clutch is engaged (i.e., the active mode), whereupon the door begins to open in an arc (assuming a hinged door). Upon the conclusion of interval T2, the door operator sequencer de-energizes the motor while maintaining the clutch in an energized state, whereupon the door is decelerated by the frictional resistance inherent in the motor and drive train assembly and fixed in the open position. The amount of the arc of opening is user-determined by interval T2. The sequencer causes the operator to pause for interval T3, during which time the user presumably passes through the now open door. Upon conclusion of T3, the sequencer causes the motor to reenergize to actively move the door to the closed position. If the door positioning sensor confirms door closure, and presumed re-latching, the operator de-energizes the motor and the clutch is disengaged (i.e., the passive mode) so that the door is substantially free swinging.

The present invention includes a hierarchial sequencer that queries whether the user wishes to open the door, close the door if already open, or interrupt an opening-closing cycle already in progress—thus allowing the user to bring the door to a desired opened position and leave it there indefinitely in this position in a now passive mode.

BRIEF DESCRIPTION OF THE DRAWING

The assembly of the present invention has other objects and features of advantage which will be more readily apparent from the following description of the Best Mode of Carrying Out the Invention and the appended claims, when taken in conjunction with the accompanying drawing, in which:

BEST MODE OF CARRYING OUT THE INVENTION

Figure 1:
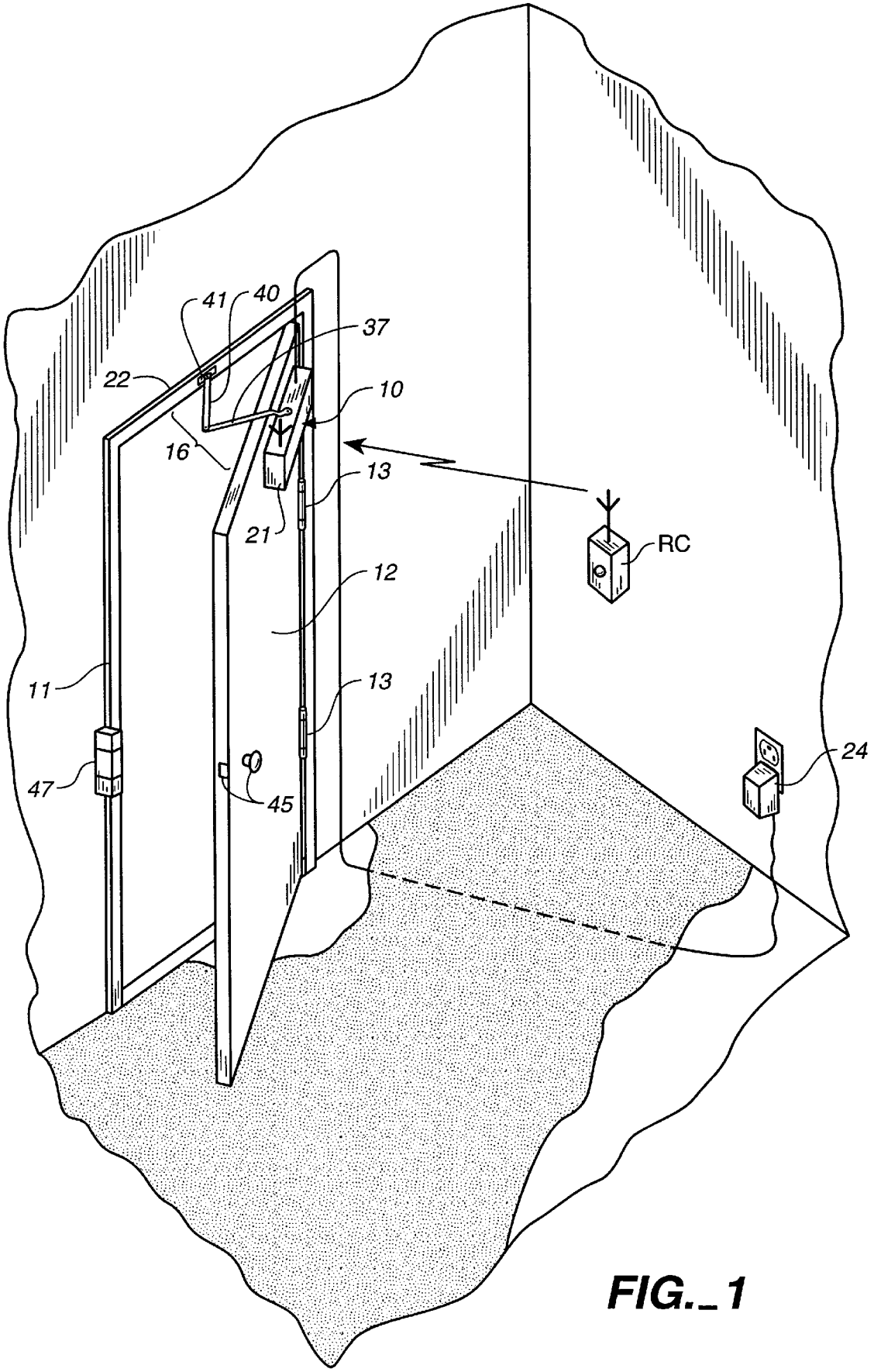
FIG. 1 is a fragmentary top perspective view of the door operator apparatus constructed in accordance with the present invention and mounted between a pivotal swinging door and a building structure.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

DESCRIPTION OF THE PREFERRED EMBODIMENT

Figure 2:
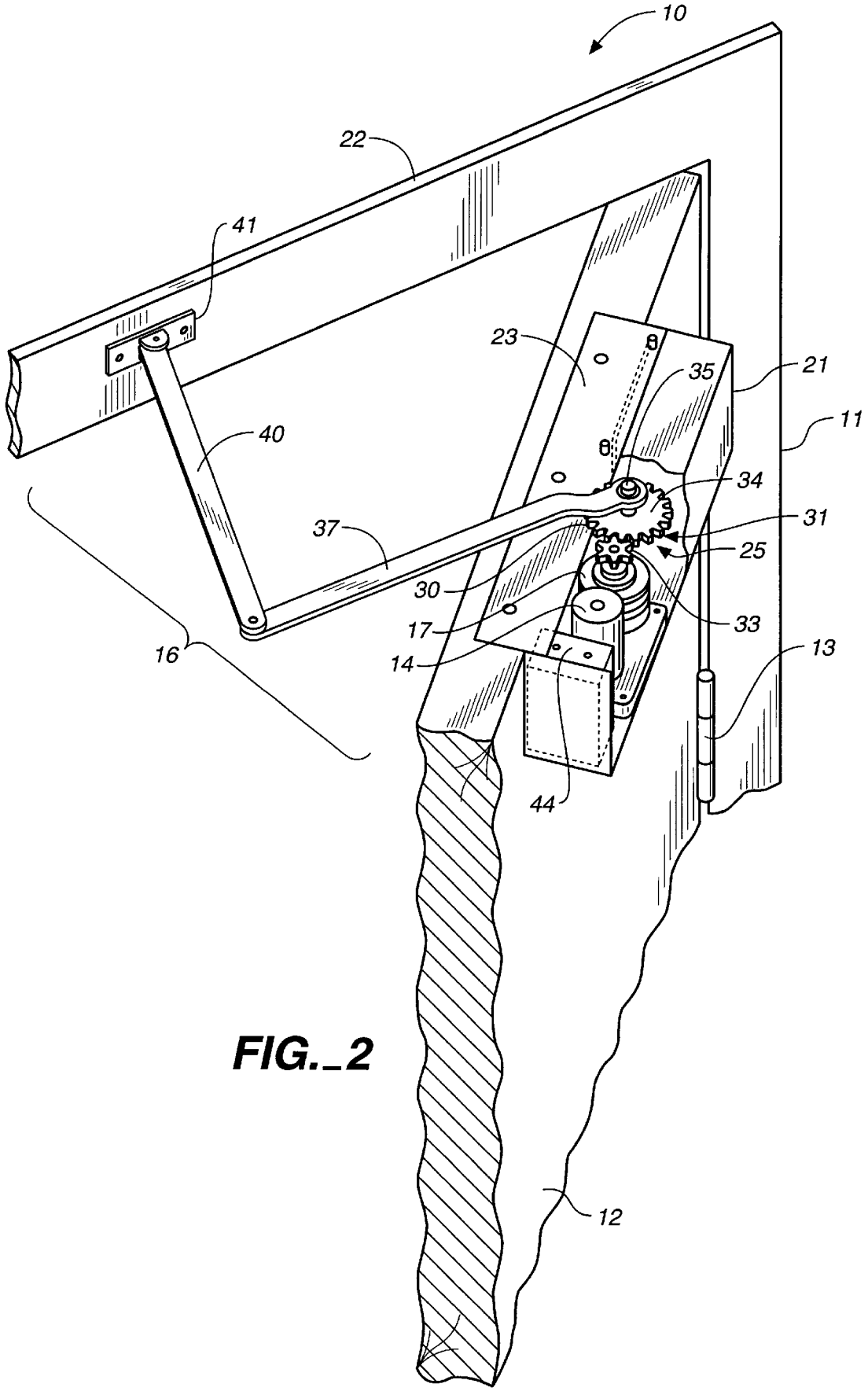
FIG. 2 is an enlarged, fragmentary top perspective view, partially broken away, of the door operator apparatus of FIG. 1, and having the housing mounted to the door.

Attention is now directed to FIGS. 1–4 where a normally passive electric door operator apparatus, generally designated 10, is illustrated operably mounted between a building structure 11 and a door 12 movably mounted to a building structure 11 through a door coupling device 13 for movement of the door between a closed position (FIG. 4) and an opened position (FIGS. 1 and 2). Briefly, operator apparatus 10 includes a motor assembly, generally designated 14, having a clutch shaft 27, and a linkage device, generally designated 16, operably coupled to door 12 for movement thereof between the opened position and the closed position. The present invention further includes an electronic clutch assembly, generally designated 17, selectively movable between an active mode and a normally passive mode. In the active mode, clutch assembly 17 actively couples clutch shaft 27 to linkage device 16 for selective powered movement of door between the opened position and the closed position. In the normally passive mode, clutch assembly 17 decouples output shaft 15 from linkage device 16 to permit selective manual movement of door 12 between the opened position and the closed position which is substantially free of movement resistance other the resistance caused by the door hinges (i.e., coupling device 13).

The door operator of the present invention further includes a controller unit, generally designated 20, operably coupled to motor assembly 14 and clutch assembly 17 for selective operation thereof by a user. In accordance with the present invention, clutch assembly 17 is in the active mode when actively opening, arresting movement when open, and in the process of closing door 12. Importantly, for the remainder of the time, clutch assembly 17 is normally in the passive mode which permits manual movement of the door free of the resistance caused by external components acting on the door (i.e., motor resistance, automatic door closers, etc.) other than the resistance caused by coupling device 13.

Accordingly, the door operator of the present invention enables the door to function as a normal free swinging door, except during powered opening, braking and/or closing of the door by the door operator, which is unencumbered by the resistance forces generated by the door operator or by an externally mounted door check. This arrangement provides all the benefits of the prior art powered door operators and door openers while eliminating their disadvantages, namely, resistance forces substantially caused by the motor, gear reduction train, and the internal or external automatic door closing springs. Hence, a door employing the door operator of the present invention can be manually manipulated as if the door operator were not present since the only resistance force encountered by an individual manually opening the door (such as in a power outage or a fire) is substantially that resistance caused by the door hinges and the weight of the door itself.

Figure 3:
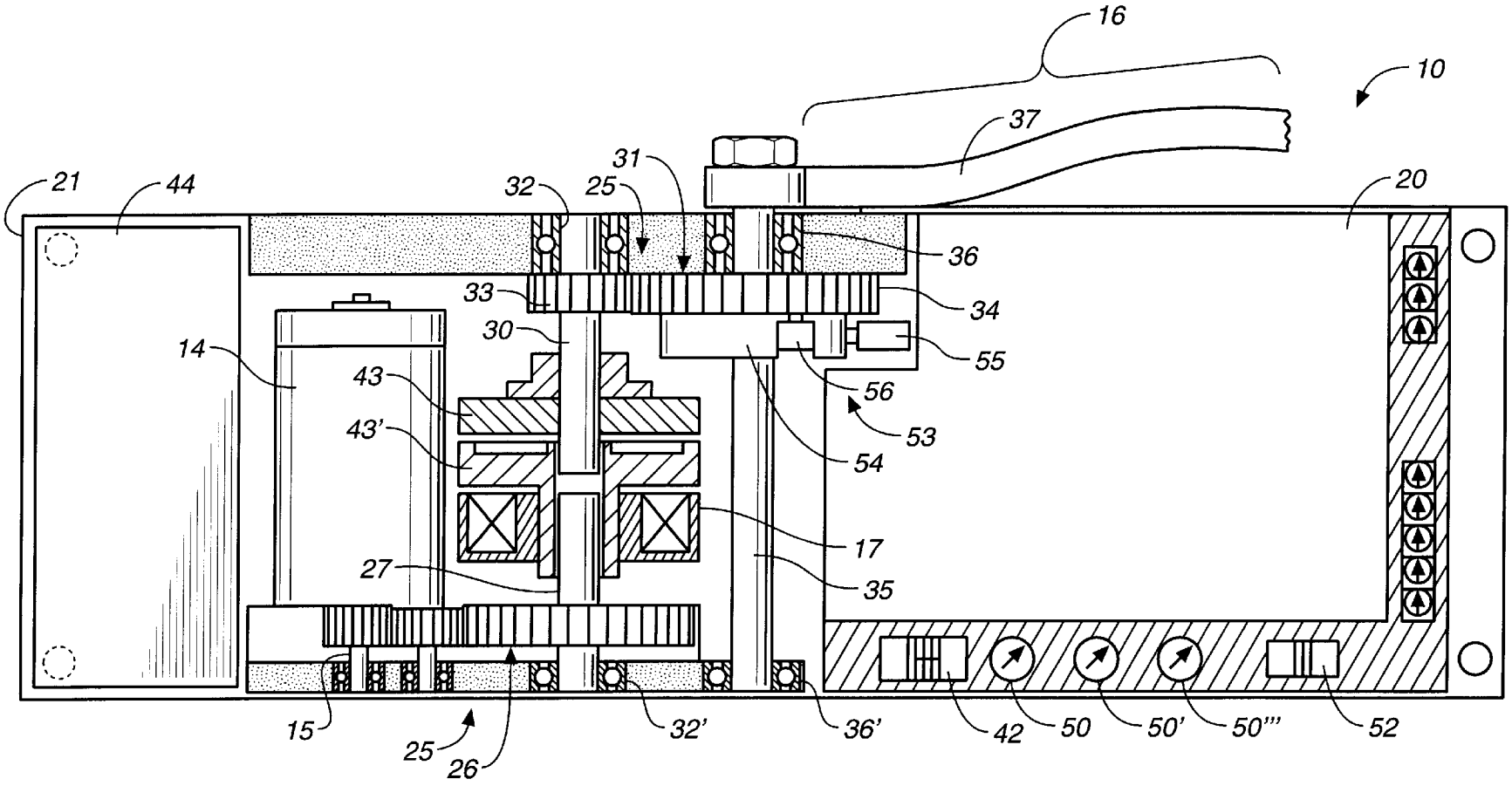
FIG. 3 is an enlarged, fragmentary side elevation view, in cross-section, of the housing of door operator apparatus, and illustrating the motor assembly and the clutch assembly.
Figure 4:
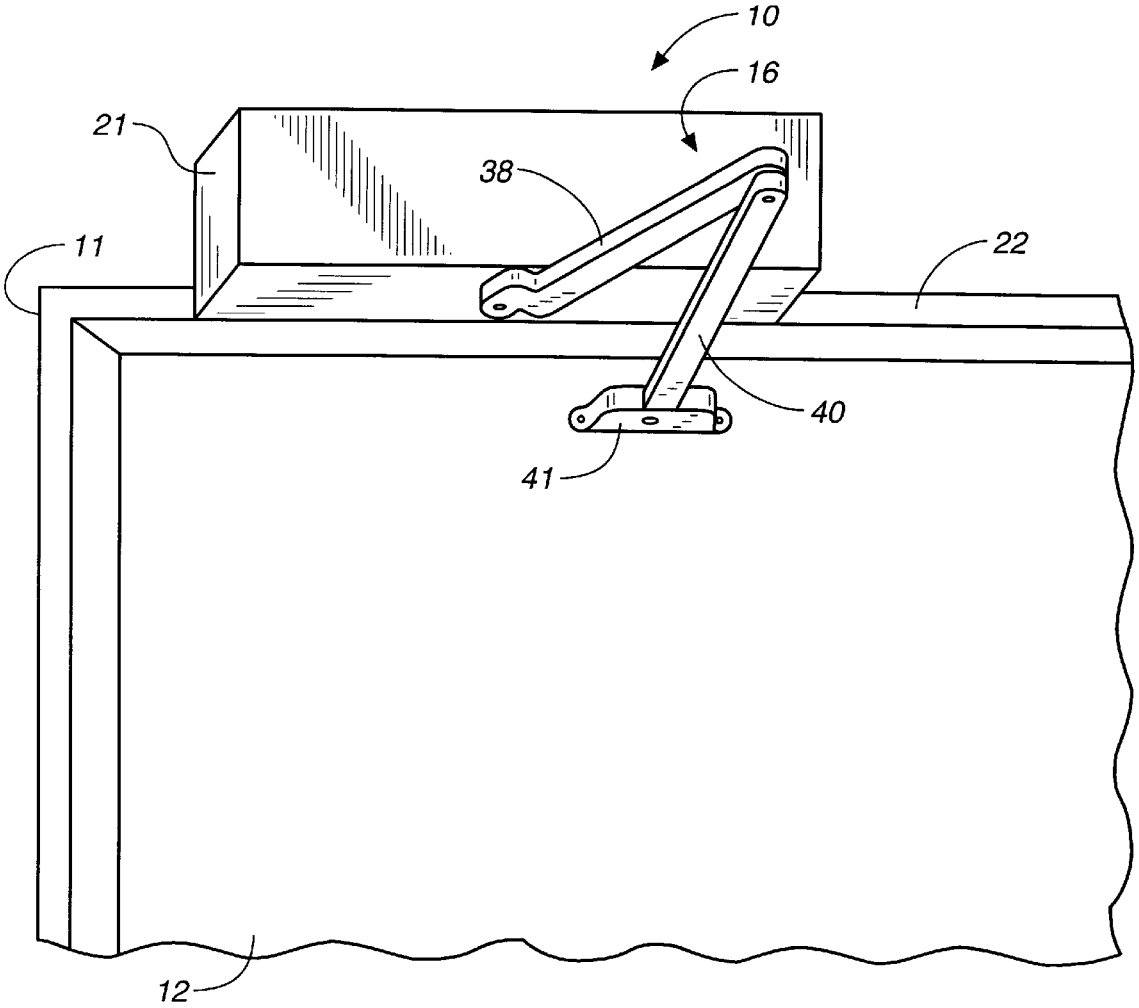
FIG. 4 is an enlarged, fragmentary bottom perspective view of the door operator apparatus of FIG. 1 having the housing mounted to the interior door lintel causing the door to open outwardly.
Figure 5:
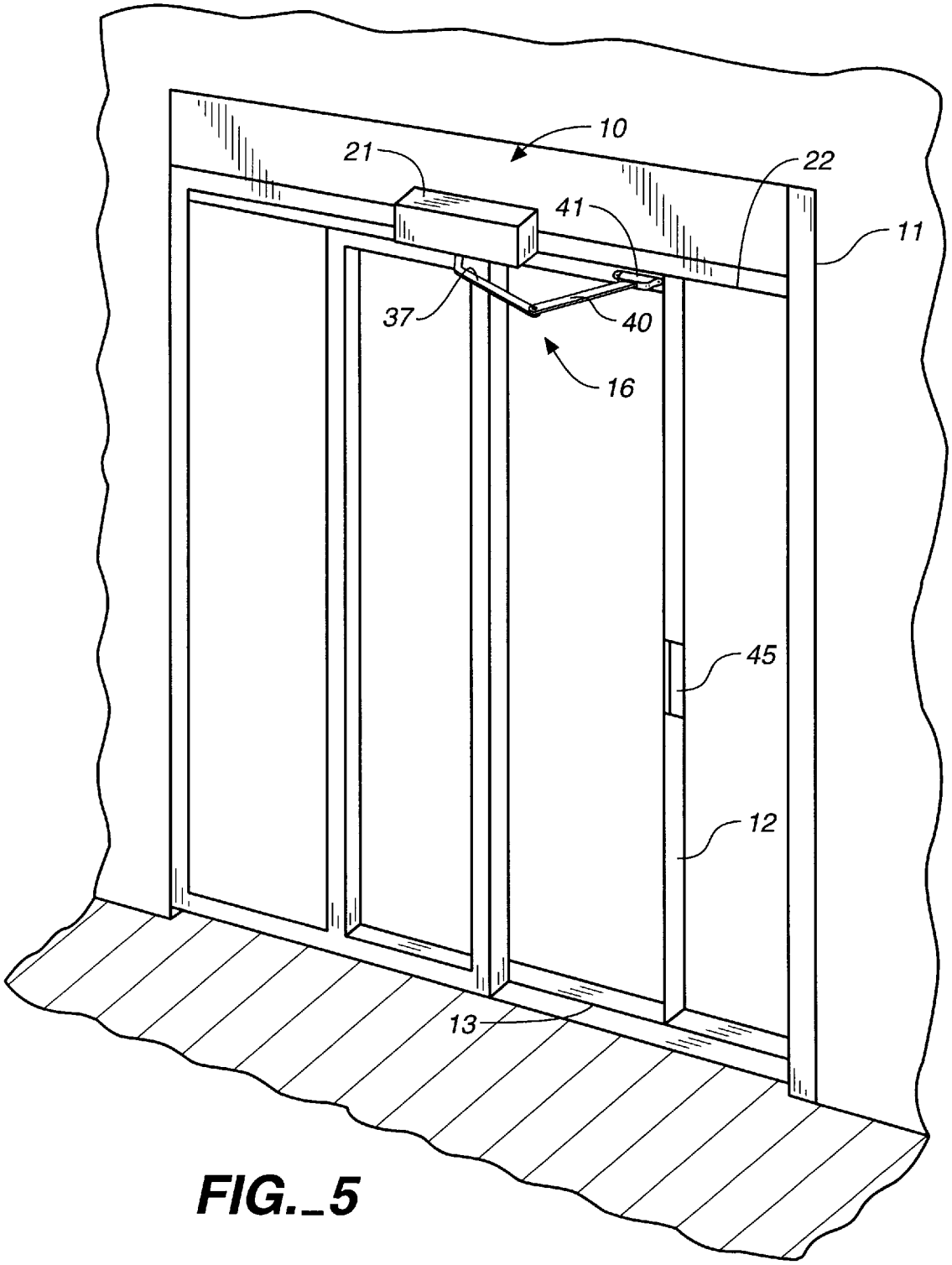
FIG. 5 is a fragmentary top perspective view of the door operator apparatus of FIG. 1 mounted to a sliding-type door.

FIGS. 2 and 3 illustrate that motor assembly 14, clutch assembly 17 and controller unit 20 are supported and retained in a compact housing 21 typically no larger than a conventional spring or hydraulically dampened closer it replaces. Not only is this compact design more aesthetically pleasing than the bulky designs of the prior art, but the present invention permits operable mounting to either door 12 (FIGS. 1 and 2) or a door lintel 22 (FIG. 4). Moreover, as will be discussed in greater detail below, a single door operator unit of the present invention can be adapted to accommodate a plurality of door configurations (i.e., right hinged or left hinged doors, or outward or inward swinging doors) without substantial modification. A single unit, hence, is capable of eight (8) configurations of mounting. This added flexibility simplifies manufacture and inventory, and eases installation by the licensed technician or the self-installer since this single unit allows sight unseen installation. In contrast, the prior art door operators and openers often required an inspection of the door configuration before the proper door operator or opener arrangement could be chosen.

Depending upon whether the housing or cover of the door operator is mounted to the door or the door lintel, additional mounting brackets or plates could be provided. Preferably, door housing 21 includes a lip portion or mounting plate 23 (FIG. 2) which is adapted to mount the door operator to the top ledge of door 12 through screws or the like. This allows door 12 to be completely closed without interference of the door operator with lintel 22. This arrangement further eases alignment relative the door top ledge for proper vertical placement on the door.

In the preferred form, motor assembly 14 is provided by a high rate or high revving, bi-directional electric motor capable of operation from a low voltage source. These compact high revving motors (about 5000 rpm) can generate a similar amount of power as the much larger, high torque, low revving motors. Moreover, the low operating voltage of these motors, preferably twelve (12) volts or less provided by a common transformer 24 (FIG. 1), enables installations which are not subject to safety and/or building code considerations. Hence, installation by a licensed technician is not always necessary thereby decreasing associated costs which can escalate if the user relocates frequently.

Because a high rpm motor is employed, a gear assembly 25 must be interposed between motor 14 and linkage device 16 to reduce the operating speed of the door. This speed reduction must be substantial (approximately 840:1, as opposed to approximately 40:1 for the low rpm motors of the prior art) so that the final opening and closing rotational speed of a pivotal swinging door 12 is approximately 5–8 rpm.

A benefit of this relatively high gear reduction of the gear assembly, coupled with a de-energized motor assembly, is that it provides considerable resistance to back-driving which is advantageous when operating the door operator in windy conditions. Upon powered opening of door 12 by door operator 10 to the chosen opened position, motor assembly 14 is de-energized while clutch assembly 17 is still retained in the engaged position (i.e., the active mode) for a predetermined time T3 (to allow safe passage, as will be discussed below) before automatically moving door 12 back to the closed position. Hence, this resistance to back-driving will brake door 12 in place in the opened position, resistant to wind forces.

Referring now to FIG. 3, an output shaft 15 of motor assembly 14 is coupled to a first gear train 26 of gear assembly 25, composed of several gear reductions (approximately 1:166). A clutch drive shaft 27 is rotatably coupled to first gear train 26 at one end thereof while an opposite end is operably coupled to one side of clutch assembly 17. Similarly, a clutch pinion shaft 30 is rotatably coupled to an opposite side of clutch assembly 17 while the opposite end is coupled to a second gear train 31 of gear assembly 25. Pinion shaft 30 and clutch shaft 27 are co-axially mounted, each with an end rotatably supported by a bearing member 32, 32'.

A pinion gear 33 of second gear train 31 (FIG. 2) is intermeshed with a drive gear 34 mounted to a linkage drive shaft 35 which is rotatably supported at opposite ends to a pair of bearings 36, 36' for the final gear reduction (approximately 1:4). FIGS. 1–3 illustrate that linkage drive shaft 35 drives linkage device 16 to power open or close door 12 when clutch assembly 17 is engaged or in the active mode. Linkage device 16 includes a first arm 37 mounted to a splined end of linkage drive shaft 35 while an opposite end of first arm 37 is pivotally mounted to an end of a second arm 40. An opposite end of second arm 40 is pivotally mounted to a mounting bracket 41 formed to affix to either the door lintel 22 (FIG. 2), when door operator 10 is mounted to door 12, or door 12 (FIG. 4), when door operator 10 is mounted to lintel 22. Further, linkage drive shaft 35 and first arm 37 can accommodate any functional operational angle because there are no stops within the mechanism to rotation. Any initial angle may be selected as long as the door close sensor 53 is calibrated and aligned to read the door as being closed when the door is actually closed.

As mentioned, torsional forces are transmitted from first gear train 26 to second gear train 31 through electrically operated clutch assembly 17. In the preferred embodiment, clutch assembly 17 is provided by a small solenoid operated clutch commonly applied in other industrial applications. Slippage of the clutch limits the torque transmission between the gears and the motor so as not to cause damage thereof in the event of an obstruction in the door path. Moreover, this buffering permits the use of a smaller inexpensive gears, which, incidently, allows more miniaturization of the entire device.

Similarly, to reduce the clutch size, solenoid clutch assembly 17 is interposed at an intermediate point between gear assembly 25 (i.e., between first gear train 26 and second gear train 31). This gear 31 reduces the rotational torque to a level which can be handled by these small clutches. Additionally, the more complex first gear train 26 is shielded from extended wear and tear when door 12 is manually manipulated.

Accordingly, when clutch assembly 17 is in the passive mode or disengaged by controller unit 20, linkage device 16 is only operably coupled to second gear train 31 which offers minimal gear train resistance due to the single gear reduction between pinion gear 33 and drive gear 34. Hence, in the normally passive mode, door 12 can be freely manually manipulated in a fashion substantially unimpeded and unencumbered by the resistance forces caused by the first gear train and the motor.

To control the simultaneous operation of all the components of the door operator of the present invention, a controller unit 20 is included adjacent motor assembly 14 and clutch assembly 17. The novel features and operation provided by controller unit 20, to be discussed in greater detail in the Operation of the Preferred Embodiment, are preferably integrated into a typical circuit board employing commonly known components. It will be appreciated, however, that a central microprocessor could easily control the components of door operator 10 without departing from the true scope and nature of the present invention.

Motor assembly 14 is preferably bi-directional so that a single motor may be utilized for both opening and closing door 12 under power. This powered door closure is preferable to conventional spring-type door closers since the closing force applied to the door can be much greater than that supplied by spring-type closers, which is beneficial in windy conditions. As previously indicated, the closing force of these prior spring-type door closers is limited due to resistance to manual opening of the door caused by the spring.

Upon simultaneous energization of clutch assembly 17 and motor assembly 14 (i.e., the active mode) by operation of controller unit 20, the two opposing clutch plates 43, 43' of clutch assembly 17 are brought into frictional interengagement so that the rotational torque transmitted through first gear train 26 can act upon second gear train 31 to drive linkage drive shaft 35, and hence, linkage device 16.

Controller unit 20 further automatically disengages clutch plates 43, 43' (i.e., the passive mode) after powered movement of door 12 back to the closed position which permits door 12 to operate in a free swinging manner. Therefore, due to the bi-directional powered capabilities of the present invention, a separate internal or external door closer is unnecessary which, in turn, eliminates any adverse resistance to manual operation of the door caused thereby.

While motor assembly 14 is normally powered through a low voltage transformer 24 (FIG. 1) plugged into a standard household outlet, rechargeable batteries 44 are preferably carried in housing 21 operably connected thereto in the event of a power failure. Hence, door operator 10 may continue operation in such situations.

In the preferred embodiment, controller unit 20 is controlled through a remote control (RC) unit selectively operated by the user to power open and/or power close the door through the door operator of the present invention. The remote control receiver is operably coupled to controller unit 20, and is preferably situated in housing 21, while the hand-held remote control transmitter is carried by the user. Any type of wave transmission, such as radio, infrared or audio waves, can be employed as the communication medium. These type transmitters and receivers are well known in the art, and do not alone constitute a novel feature of the present invention. Further, it will be appreciated that wall mounted buttons and/or weight sensitive pads could easily be provided to control the operation of the present invention.

Should door 12 include a latching or locking mechanism 45 (FIG. 1), the present invention preferably cooperates with an unlatching device 47, commonly referred to in the industry as an electrical strike which selectively interacts with the latching mechanism 45 to permit operation of door operator 10. These unlatching devices, well known in the field, must release the latching mechanism just prior to the powered opening of the door by the door operator. The present invention may also work in conjunction with our portable unlatching device enabling deadbolt and latch operation as disclosed in U.S. Pat. No. 5,095,654.

Energization or operation of electrical strike 47 to release latching mechanism 45 is preferably operated through controller unit 20. Upon selective activation of the door operator by the user, via remote control, electrical strike 47 releases latching mechanism 45 just prior to powered opening of the door by door operator 10. (Simultaneous operation of these components, of course, could cause operation problems which adversely affect smooth performance.)

Accordingly, to coordinate this delay in operation, the controller unit of the present invention includes at least one timer, generating time intervals, to control the starting, stopping and duration of operation of motor assembly 14, clutch assembly 17 and unlatching device 47, relative to the activation of the unit by the user. Briefly, for example, upon selective powered opening of door 12 from the closed position to the opened position, controller 20 delays the engagement of clutch assembly 17 and the energization of motor assembly for a predetermined time interval T1, after initial activation of operator 10 user, to allow unlatching device 47 to completely release door latching mechanism 45 before commencement of powered opening of door 12. Controller board 20 includes a timer for this purpose which is adjustable by potentiometer 50 which is easily accessible on the surface of control board 20 upon removal of housing cover 21. This delay period or predetermined time interval T1 is adjustable from 0–5 seconds to accommodate a variety of unlatching devices.

In still another application, and in accordance with the present invention, the accurate positioning of door 12 in the opened position, relative the closed position, is governed through another timer to control the duration of time T2 which motor assembly 14 is in operation. Calculating the arcuate positioning of the door as a function of motor operation time T2 (since the motor speed is substantially constant) is preferable to the mechanical adjustments or switches employed in the prior art to precalculate the opening angle relative to a reference point assuming a hinge mounted door and the opening width of a sliding door. Not only are these mechanical devices subject to wear, but they are not easily adjustable. Each time the user desires to change or alter the opening angle, and/or the door operator requires remounting to another door, these mechanical settings must be internally reset which is time consuming and laborious.

To increase the opening angle in the present invention, the duration of operation of motor assembly is simply increased, while a smaller operational duration yields a smaller angle. Similar to the other timers, a variable adjustment, such as a potentiometer 50', is provided to control the motor operation time, and hence, the opening angle. Due to the constant rotational speed of the motor assembly, the opening angle can easily be adjusted through manual manipulation of this adjustment. Hence, a plurality of door opening angles are provided simply by varying the variable timer.

In another instance, controller unit includes another timer which delays the automatic closure of door 12 for a predetermine time T3, after door operator 10 has power opened the door to the opened position. Such a delay enables the user or multiple users sufficient time to safely traverse through the door passageway. Again, this timer may include a potentiometer to manually vary the delay time from between about 5 seconds to about 60 seconds. These time delay adjustments permit customization of the door operator units to the specific needs of the individual users.

Upon installation, operator 10 must be configured for a right-hand or left-hand hinged door. The initial direction of rotation of linkage drive shaft 35 must be selected as to rotate in a direction such to cause the door to move in an opening direction. This aspect is controlled by switch 42 located on controller 20 which controls the initial polarity of voltage going to motor 14 subsequently determining the initial direction of rotation of linkage drive shaft 35.

This characteristic of the linkage drive shaft to initiate opening of the door with either counter clockwise or clockwise rotation is achievable in large part due to the lack of a return spring, and additionally, the elimination of cams, switches, and mechanical stops which are typically used to control door opening width. As previously discussed, door opening width is achieved by controlling the time of opening duration as established by time T2. This unique ability to select the initial rotation of the linkage drive shaft to cause opening is not previously expressed in the prior art.

In the preferred embodiment, the application of switch 42 enables the installer to select the initial direction of rotation of linkage drive shaft 35. In the past, installers have been typically required to select a separate model from the manufacturer for left-hand and right-hand hinged doors. Switch 42 enables the installer to be free from this critical aspect of product selection. Additionally, this allows operator 10 to be potentially relocated from an installation with a left-hand door to a right-hand door. Thus, the handicapped consumer has the advantage of a portable product that precludes the need to purchase an additional unit upon relocation.

In another novel application of the present invention, to sense obstructions in the door pathway which prevent powered movement of door 12 to either the opened position or the closed position, door operator 10 includes an obstruction detection device in the form of a current sensor operably coupled to motor assembly to sense current fluctuations therein. As motor assembly strains or struggles to overcome the obstruction, the current increases therewith. In accordance with the present invention, upon detection of the motor current increase surpassing a predetermined value for a predetermined duration, controller unit 20 automatically de-energizes motor assembly 14 and simultaneously disengages clutch assembly 17 so that door 12 is substantially free-swinging (i.e., the passive mode). This reduces wear and tear of the clutch assembly and the motor assembly, while permitting the obstruction to dislodge or be removed.

In the preferred for form, the motor assembly operates in a current range between about ½ amp to about 1 amp. Should the current of motor assembly surpass about 3 amps for a duration of time T4 between about 0.4 to 1 seconds, controller unit 20 will assume an obstruction is present which will automatically cause clutch assembly 17 (and, hence, door operator 10) to enter the passive mode. These values may of course be varied without departing from the invention.

It will be understood, however, that the obstruction detection device could be provided by an assembly detecting the slippage of clutch assembly 17 as well for a predetermined duration.

In an alternative embodiment of the present invention, an automatic closing mode may be included which automatically closes door 12 after delay when it is in the opened position. For example, operator 10 may be configured in this mode when fire codes require closure of doors when not being used. Moreover, in emergency situations, the automatic closing mode could be automatically activated in response to one or a number of warning alarms, such as burglary, fire and smoke alarms. This can be accomplished through wired or wireless communications operably coupled to controller unit 20.

An auto-close switch 52 located on housing 21 may be provided which activates or deactivates the automatic closing mode. This causes controller unit 20 to automatically close door 12 in the event the door is manually opened, with the door operator in the passive mode, and left in the opened position. Upon sensing that door 12 is in the opened position, controller unit 20 will automatically close door 12 after a delay. The time period of this delay T5 adjusted by potentiometer 50", can be set to 5 to 60 seconds.

Further, if the automatic-close mode is activated or turned ON, should an obstruction in the door pathway be encountered whereby the obstruction detection device places the door operator in the passive mode, the door may resume closure after another adjustable time delay T6 (between about 5 seconds to about 60 seconds) to close door 12. This cycle will repeat until door 12 is moved to the closed position.

While the adjustable time delays for door closure (i.e., T3, T5 and T6) have been described in detail as separate timing devices, it will be understood that all door closing time delays are preferably operated through a single timing device and adjustable potentiometer.

In order to detect the position of the door (whether in the opened or closed position) in the automatic closing mode, a door positioning sensor 53 is included as shown in FIG. 3. Sensor 53, in communication with controller unit 20, cooperates with linkage drive shaft 35 which rotates when door 12 is moved to between the opened position and closed position.

Preferably, positioning sensor 53 includes wheel 54 which is affixed to the linkage drive shaft 35 which rotates about the longitudinal axis thereof during movement of door between the opened and closed position. A small magnet 56 is mounted to wheel 54 strategically positioned about its circumference. A magnet sensor 55, preferably an electronic magnetic detection device (solid state Hall Effect sensor), is fixedly positioned near wheel 54 which become conductive as magnet 56 approaches sensor 55 during rotation of the wheel. In the preferred form, magnet 56 is positioned on wheel 54 such that when door 12 is in the closed position, magnet 56 is facing or in close proximity to sensor 55 to induce conduction therewith. Upon opening of the door, magnet 56 rotates out of proximity of magnet sensor 55 which is, subsequently, becomes non-conductive. This change of electrical state is detected by controller 20 indicating that door 12 has moved from the closed to open position.

Upon initial installation, link arm 37 can accommodate any functional rotational angle because there are no stops within 360 degrees of rotation. Any initial angle may be selected as long as the door close sensor 53 is calibrated and aligned to read the door as being closed when the door is actually closed. Calibration is accomplished manually by rotating wheel 54 which is frictionally affixed and capable of slipping on shaft 35 during adjustment to position magnet 56 in proximity of magnet sensor 55 when the door is in the closed position.

Sensor 53 could be provided by an optical sensor or a microswitch carried on a cam wheel without departing from the present invention.

Accordingly, based on the position of the door, when the remote control unit is selectively activated, controller unit either begins to power open door 12, if sensor 53 determines door 12 is initially in the closed position, or begins to power close door 12, if sensor 53 determines door 12 is initially in the opened position. Further, the positioning sensor is useful in determining when door 12 has been moved to the closed position so that controller unit 20 can de-energize motor assembly 14, disengage clutch assembly 17, and reset all timers (i.e., the passive mode). In the automatic-close mode, if door 12 is in the opened position, sensor 53 directs controller unit 20 to initiate the timer delay before automatically closing the door.

Additionally, in the present method, before the energizing step to power open door 12 from the closed position to the opened position, automatically unlatching manually movable latching mechanism 45 through an unlatching device 47 operably coupled to latching mechanism 45. Moreover, after the unlatching step, delaying commencement of the energizing step through timer to power open the door. Finally, after the selective energizing step for powered opening of the door from the closed position to the opened position, delaying commencement of the energizing step through timer to power close from the opened position to the closed position.

From the description of the present apparatus, it will be understood that a method for powered opening and closing of door 12 through a normally passive powered door operator 10 is provided comprising the steps of: selectively engaging electronic clutch assembly 17 to an active mode which couples electronic motor assembly 14 to linkage device 16, operably coupled to door 12 for powered door movement between an opened position and a closed position; energizing motor assembly 14 for driving the powered door movement; and after the energizing step, automatically disengaging electronic clutch assembly 17 from the active mode to a passive mode. The passive mode, of course, permits substantially unencumbered, selective manual movement of door between the opened and closed position. Clutch assembly 17 is in the active mode only during the powered opening, braking, holding, and closing of door 12 and is in the passive mode the remainder of the time.

Additionally, in the present method, upon initiation of remote activation by the user, the immediate energization of unlatching device 47 is achieved. A delay step is provided through controller 20 before opening movement is commenced through the energization of motor assembly 14 and clutch 17. Energization of motor 14 occurs for a discrete selectable time period during opening of door. Clutch 17 remains engaged during a delaying step. Finally, motor 14 is re-energized as to reverse its direction for the powered closing of door 12 from the opened position to the closed position. Upon confirmation of door closure from position sensor 53, controller 20 de-energizes motor assembly 14 and clutch 17 rendering door 12 closed and operator 10 in a passive state free for subsequent manual operation.

These features, along with the operation of the other design features will be described in much greater detail henceforth in the detailed description of the operation of the present invention.

OPERATION OF THE PREFERRED EMBODIMENT

Figure 6:
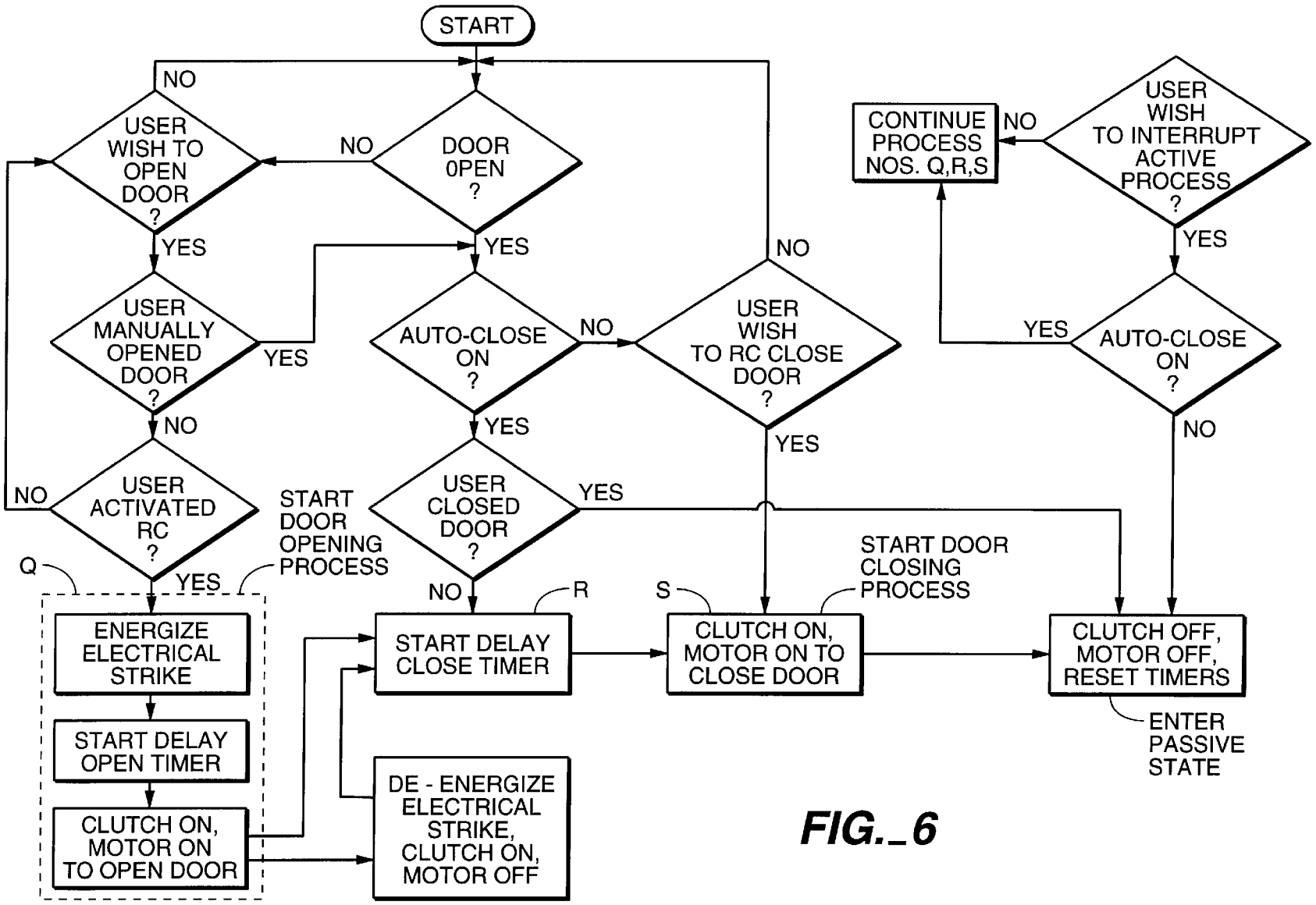
FIG. 6 is a flow diagram illustrating the method and operational features of the door operator of the present invention.

Referring now to TABLE A set forth below and the flow diagram of FIG. 6, the novel operation of the preferred embodiment will be described.

TABLE A

| INITIAL CONDITION | ACTION | RESULT |
|---|---|---|
| 1. DOOR CLOSED AUTO-CLOSE OFF | MANUALLY OPEN DOOR | DOOR STAYS OPEN INDEFINITELY UNTIL: A. DOOR IS MANUALLY CLOSED B. REMOTE CONTROL IS ACTIVATED TO CLOSE DOOR C. FIRE ALARM TURNS ON AUTO CLOSE TO CLOSE DOOR |
| 2. DOOR CLOSED AUTO-CLOSE ON OR OFF | REMOTE CONTROL ACTIVATED | DOOR OPERATOR ENERGIZES ELECTRICAL STRIKE, DOOR OPENS, DOOR WAITS (5–60 SEC.), DOOR CLOSES, DOOR RESUMES PASSIVE MODE, FREE FOR MANUAL USE |
| 3. DOOR OPEN, IN PROCESS OF OPENING, WAITING, OR CLOSING, AUTO-CLOSE OFF | REMOTE CONTROL ACTIVATED | DOOR ENTERS INTO PASSIVE MODE FOR INDETERMINATE TIME, DOOR MAY BE USED MANUALLY |
| 4. DOOR IN OPEN PASSIVE MODE | REMOTE CONTROL ACTIVATED | DOOR OPERATOR ENGAGES IMMEDIATELY, BRINGS DOOR TO CLOSED POSITION, DOOR RESUMES PASSIVE MODE |
| 5. DOOR CLOSED AUTO-CLOSE ON | MANUALLY OPEN DOOR | DOOR IS IN PASSIVE MODE, IF NOT CLOSED MANUALLY WITHIN SET TIME (5 TO 60 SEC.) DOOR CLOSES UNDER POWER, AND RESUMES PASSIVE MODE |
| 6. DOOR OPEN AUTO-CLOSE OFF | AUTO-CLOSE ACTIVATED BY FIRE ALARM SYSTEM | DOOR OPERATOR CLOSES AFTER SET TIME EXPIRES (5 TO 60 SEC.), THEN RESUMES PASSIVE MODE, FREE FOR MANUAL USE WITHIN AUTO-CLOSE MODE |
| 7. DOOR OPEN, IN PROGRESS OF OPENING, WAITING OR CLOSING, AUTO-CLOSE ON | REMOTE CONTROL ACTIVATED | DOOR OPERATOR IGNORES REMOTE CONTROL AND CONTINUES IN THE AUTO-CLOSE SEQUENCE, RETURNING DOOR TO CLOSE POSITION AND THEN RESUMES PASSIVE MODE |
| 8. DOOR CLOSED | FIRE ALARM ACTIVATES AUTO-CLOSE | DOOR REMAINS CLOSED UNTIL MANUALLY OR AUTOMATICALLY OPERATED |

TABLE A-continued

| INITIAL CONDITION | ACTION | RESULT |
|---|---|---|
| 9. DOOR IN PROGRESS OF OPENING OR CLOSING AUTO-CLOSE OFF | DOOR IS OBSTRUCTED | DOOR OPERATOR SENSES AN OBSTRUCTION FOR (0.4–1 SEC.), AND THEN ENTERS INTO PASSIVE MODE |
| 10. DOOR IN PROGRESS OF OPENING OR CLOSING AUTO-CLOSE ON | DOOR IS OBSTRUCTED | DOOR OPERATOR SENSES AN OBSTRUCTION FOR (0.4–1 SEC.), AND THEN ENTERS INTO PASSIVE MODE, AFTER 5–60 SEC. TIME, DOOR ATTEMPTS CLOSING AND REPEAT DESCRIBED CYCLE UNTIL DOOR IS CLOSED |

Briefly, column 1 of TABLE A describes the initial setup of the door operator (i.e., automatic-close mode ON/OFF, door operator in active mode/passive mode), together with the initial condition of the door (i.e., opened position/closed position), while column 2 describes the Action applied to the door operator by the user or external device while in the particular initial set-up. Finally, the last column describes Result of the Action applied while the door operator is in the stated initial state.

In the first initial condition, door 12 is in the closed position, while the automatic-close mode is OFF. Upon a user manually opening door 12 to the opened position, the door will remain open indefinitely as a free swinging door (i.e., where door operator 10 is in the passive mode) until one of three conditions is met. First, the door may be manually closed in a free swinging state. Second, if the user activates the remote control unit, positioning sensor 53 will detect that door 12 is in the opened position, whereby the door operator will enter the active mode (i.e., engage clutch assembly 17 and energize motor assembly 14) to power move door 12 to the closed position. Once, door 12 is in the closed position, door operator enters the passive mode (i.e., disengage clutch assembly 17 and de-energize motor assembly 14). Finally, if a warning alarm automatically activates or triggers the automatic-close mode, the positioning sensor will detect that door 12 is in the opened position. Door operator 10 will then enter the active mode to power close door 12 to the closed position. Once, door 12 is in the closed position, door operator enters the passive mode.

In the second initial condition, door 12 is again in the closed position, while the automatic-close mode is either on or off. Upon a user activating door operator 10 through their remote control unit, the positioning sensor detects that door 12 is in the closed position, whereby door operator 10 activates electrical strike 47 to unlatch latching mechanism 45. Controller unit 20 initiates adjustable time delay T1 (about 0–2 secs.) before entering the active mode to begin opening door 12. Once door 12 is in the preset, fully opened position, another adjustable time delay T5 (about 5–60 secs.) holds door operator 10 in the opened position while still in the active mode. After expiration of this time delay T5, door operator 10 power closes door 12 to the closed position where the door operator resumes the passive mode.

Regarding the third initial condition in TABLE A, door operator 10, in the active mode and while automatic-close mode is OFF, is in the process of either opening door 12, holding the door in the opened position for time delay T3, or closing door 12. Upon a user activating door operator 10 through their remote control unit, door operator 10 enters the passive mode of an indefinite period.

In the fourth initial condition, door 12 is in the open position while in the passive mode. Upon a user activating door operator 10 through their remote control unit, the positioning sensor detects that door 12 is in the opened position, whereby door operator 10 enters the active mode to power close door 12 to the closed position. Once the positioning sensor detects that door 12 is in the closed position, the door operator resumes the passive mode.

Similarly, in the fifth initial condition, where door 12 is in the closed position with the automatic-close mode ON, and is subsequently manually opened, the positioning sensor detects that door 12 is in the opened position and initiates the time delay T3 (about 5–60 secs.). After expiration of time T3, door operator 10 enters the active mode to power close door 12 to the closed position. Once the positioning sensor detects that door 12 is in the closed position, the door operator resumes the passive mode.

Referring to the sixth initial condition of TABLE A, door 12 is in the opened condition, door operator 10 is in the passive mode with the automatic-close mode OFF. Upon activation of the automatic-close mode to the ON position in response to a warning alarm, the positioning sensor detects that door 12 is in the opened position and initiates the time delay T3 (about 5–60 secs.). After expiration of time T3, door operator 10 enters the active mode to power close door 12 to the closed position. Once the positioning sensor detects that door 12 is in the closed position, the door operator resumes the passive mode.

In the seventh initial condition, door operator 10, in the active mode and while automatic-close mode is ON, is in the process of either opening door 12, holding the door in the opened position for time delay T3, or closing door 12. Upon a user activating door operator 10 through their remote control unit, door operator 10 ignores the remote control signal and continues in the automatic-close mode sequence to close the door. Once the positioning sensor detects that door 12 is in the closed position, the door operator resumes the passive mode.

In the eighth initial condition of TABLE A, door 12 is in the closed position with the automatic-close mode OFF. Upon activation of the automatic-close mode to the ON position in response to a warning alarm, the positioning sensor detects that door 12 is in the closed position whereby the door remains closed until the door is manually or automatically opened. Should the door be opened, then initial condition five or initial condition two is followed.

Regarding the ninth initial condition, door operator 10, in the active mode and while automatic-close mode is OFF, is in the process of either opening door 12 or closing door 12. Upon door 12 encountering an obstruction in the door pathway, a current sensor in controller 20 detects a rise in the current of motor 14 for a duration of time T4 (about 0.4–1 secs.). In turn, controller unit 20 instructs door operator to enter the passive mode for an indefinite period.

Finally, in the tenth initial condition of TABLE A, door operator 10, in the active mode and while automatic-close mode is ON, is in the process of either opening door 12 or closing door 12. Upon door 12 encountering an obstruction in the door pathway, current sensor detects a rise in the current of motor 14 for a duration of time T4 (about 0.4–1 secs.). In turn, controller unit 20 instructs door operator to enter the passive mode while door 12 is still in the opened position. Thereafter, controller unit 20 initiates the time delay T6 (about 5–60 secs.). After expiration of time T6, door operator 10 again enters the active mode to power close door 12 to the closed position. This cycle is repeated if the obstruction is again encountered. Once the positioning sensor detects that door 12 is in the closed position, the door operator resumes the passive mode.

What is claimed is:

1. An electric door operator apparatus formed for mounting between a structure and a movable door for movement of the door between a closed position and an opened position, said operator apparatus comprising:

an electric motor assembly having an output shaft, said electric motor assembly being formed for mounting to one of the door and the structure and formed to drive said output shaft in two opposed directions;

a linkage device formed for mounting the other of the door and the structure for movement of the door between said open and said closed positions;

an electronic clutch assembly mounted between said output shaft and said linkage device and selectively coupling of said linkage to said motor for powered movement of the door in both directions between said open and closed position in an active mode, and said clutch assembly further selectively decoupling said output shaft from said linkage device to permit manual movement of the door between said open and closed positions substantially free of movement resistance in a passive mode; and a controller unit operably coupled to said motor assembly and to said clutch assembly and controlling powered operation of said door operator both to open and to close said door, said controller unit further automatically decoupling said linkage device from said output shaft in the absence of user input.

2. The door operator apparatus according to claim 1 wherein, said controller automatically decouples said linkage device from said output shaft when said door is in said closed position; and said controller unit is responsive to a remote control actuator device operably coupled to said controller unit upon user actuation from a location remote of said controller unit for user selective operation of said door operator.

3. The door operator apparatus according to claim 1 wherein, said controller unit activates the powered opening of said door from said closed position in response to a first input by the user, and said controller unit deactivates the powered opening of said door and decouples said output shaft from said linkage device in response to a second input by the user during opening of said door, to position said door at one of a plurality of positions between said closed position and said opened position and permit substantially resistance-free manual movement of said door by the user.

4. The door operator apparatus according to claim 1 wherein, said controller unit further includes an obstruction detection device for detecting resistance to powered movement of said door between said opened position and said closed position, said detection de-energizing said electric motor assembly and causing disengaging said clutch assembly to decouple said output shaft from said linkage device upon detecting resistance to powered movement of said door.

5. The door operator apparatus according to claim 4 wherein, said detection means includes a sensor operably mounted to said clutch assembly for detecting slippage thereof.

6. The door operator apparatus according to claim 4 wherein, said controller unit further is formed to energize said electric motor assembly and cause said clutch assembly to couple said output shaft to said linkage device to reactivate powered movement of said door upon passage of a time interval initiated after detection of resistance to powered movement of said door.

7. The door operator apparatus according to claim 1 wherein, said controller unit further includes a selectively activatable auto-close circuit connected to automatically couple said output shaft to said linkage device for powered closing of said door when said door is in said opened position and said clutch assembly has decoupled said output shaft from said linkage device.

8. The door operator apparatus according to claim 1 further including:

a first gear assembly operably interposed between said electric motor assembly and said clutch assembly and having a gear reduction ratio substantially reducing the output shaft speed of said electric motor assembly; and a second gear assembly operably interposed between said clutch assembly and said linkage device, said second gear assembly further reducing the output shaft speed and being formed to provide minimal frictional resistance to movement upon manual movement of the door by the user.

9. The door operator apparatus according to claim 1, and in combination a door mounted for pivotal movement to a structure between said open position and said closed position, said electric motor assembly being mounted to one of said door and said structure and the linkage device being mounted to the other of said door and said structure.

* * * * *